US011287213B1

(12) United States Patent
Grace et al.

(10) Patent No.: US 11,287,213 B1
(45) Date of Patent: Mar. 29, 2022

(54) INSULATED GRIP AND RELATED METHOD OF INSTALLATION

(71) Applicant: Grace Engineering Corp., Memphis, MI (US)

(72) Inventors: Nathaniel E. Grace, Fort Gratiot, MI (US); Scott C. Prater, Imlay City, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 17/078,619

(22) Filed: Oct. 23, 2020

(51) Int. Cl.

| | |
|---|---|
| ***F41C 23/16*** | (2006.01) |
| ***F41B 5/14*** | (2006.01) |
| ***F41C 23/10*** | (2006.01) |
| ***F41C 23/18*** | (2006.01) |
| ***F41B 5/00*** | (2006.01) |
| ***F41B 5/10*** | (2006.01) |

(52) U.S. Cl.
CPC ..... *F41C 23/10* (2013.01); *F41B 5/00* (2013.01); *F41B 5/10* (2013.01); *F41C 23/16* (2013.01); *F41C 23/18* (2013.01); *F41B 5/14* (2013.01)

(58) Field of Classification Search
CPC .. F41B 5/00; F41B 5/14; F41B 5/1403; F41C 23/16
See application file for complete search history.

(56) References Cited

U.S. PATENT DOCUMENTS 3,397,685 A * 8/1968 Walker ..... F41B 5/0068 124/88
5,585,026 A * 12/1996 Smith, Jr. ..... F41B 5/14 219/528
5,615,663 A * 4/1997 Simonds ..... F41B 5/14 124/23.1
5,842,460 A * 12/1998 Barber ..... F41B 5/14 124/88
5,934,267 A * 8/1999 Briner ..... F41B 5/14 124/88
6,988,495 B1 * 1/2006 Van Hoorn ..... F41B 5/14 124/88
10,006,738 B2 * 6/2018 Stoppenhagen ..... F41B 5/1442
2008/0052979 A1 * 3/2008 Lee ..... F41A 23/04 42/94

OTHER PUBLICATIONS

Gurav, Jyoti L. et al. "Silica Aerogel: Synthesis and Applications," 2010.

* cited by examiner

*Primary Examiner* — John A Ricci
(74) *Attorney, Agent, or Firm* — Warner Norcross + Judd LLP

(57) ABSTRACT

A grip for a weapon is provided and can include a user engagement area including a first surface on the weapon, a first layer including an aerogel, the first layer disposed adjacent the first surface, and a first engagement member disposed over the first layer in the user engagement area. The first engagement member includes an exterior surface that engages an appendage of a user when the user holds the weapon. The first layer including the aerogel insulates the first engagement member so that thermal energy transfer between the user and the weapon is impaired. The weapon can be an archery bow, a firearm or any other weapon including a grip or portion that is engaged by an appendage of a user.

20 Claims, 8 Drawing Sheets

INSULATED GRIP AND RELATED METHOD OF INSTALLATION

BACKGROUND OF THE INVENTION

The present invention relates to gripping surfaces for weapons, and more particularly, to a grip including an aerogel to prevent or impair transfer of thermal energy between the weapon and a user.

Weapons are used for a variety of activities, and frequently are used in cold climates. Such weapons can include archery bows and rifles, which can be used to pursue wild game, such as deer, elk, moose, caribou and other animals. While using such weapons in the wild, a shooter typically will carry and hold the weapon for long periods of time in their hands. The user will grasp the weapon at a particular area, such as a grip, so the weapon is ready for use when the wild game comes into range.

Frequently, the weapon is constructed from a large piece of metal, such as aluminum or steel. As an example, an archery bow includes a riser constructed from aluminum. A rifle, shotgun or handgun typically is constructed primarily from steel. When such materials are exposed to the cold, the weapon acts as a heat sink and becomes rather cold in temperature as well. In turn, the grip associated with the weapon also acts as a heat sink, pulling thermal energy from the user's hands or other appendage engaging the weapon. As a result, the user's hands or other appendages can become cold rather quickly. In such cases, the user can lose dexterity in their hands, which can make it difficult to grip and handle the weapon efficiently. In extremely cold conditions, if the user is not careful holding the weapon and its grip, the user can experience numbness or frostbite by holding the weapon for extended periods.

To address the above issues, and similar issues with weapon grips becoming cold, most users wear gloves to insulate their hands from the cold grip. While this works, the grip still can act as a heat sink, pulling heat from the user over time. The gloves also can impair some movement of the user's hands. Some manufacturers will include a battery powered heating element in the grip to warm the user's hands. While this works, that variation in thermal energy at the grip and in the surrounding material of the weapon can change the function of the weapon in some cases. The heating element also can consume energy from a power source, such as batteries, and can be rather costly when the grip and its heating element is used for long periods.

Accordingly, there remains room for improvement in the field of insulating a user's hands and appendages from a weapon via a specially constructed grip that prevents the transfer of thermal energy to or from a user gripping that grip.

SUMMARY OF THE INVENTION

A grip for a weapon includes an aerogel layer that insulates a user's hand from the weapon, thereby impairing transfer of thermal energy between the user and the weapon.

In one embodiment, the weapon includes a user engagement area including a first surface on the weapon. A first layer of aerogel can be disposed adjacent the first surface. A first engagement member can be disposed over the first layer in the user engagement area. The first engagement member can include an exterior surface configured to engage an appendage of a user, such as a user's hand or other body part.

The first layer of aerogel can insulate the first engagement member so that thermal energy transfer between the user and the weapon is impaired.

In another embodiment, the aerogel can be an open-celled, mesoporous, solid foam comprising a network of interconnected structures. The foam can exhibit a porosity or non-solid volume of optionally greater than 50%, greater than 60%, greater than 70%, greater than 80%, greater than 90%, or greater than 95%.

In still another embodiment, the aerogel can have a density of less than 0.1 g/cm$^3$, and the aerogel can be a type of open cell foam that comprises optionally at least 80% gas, at least 90% gas or at least 95% gas.

In yet another embodiment, the first layer, being an aerogel, can include an outer polymeric layer. A second surface of the first layer can be opposite the outer polymeric layer, such that interstitial spaces of the aerogel are exposed at the second surface. The second surface can be tacky and can exhibit some levels of adhesion. The outer polymeric layer can be disposed between the first layer and the first engagement member.

In even another embodiment, the first engagement member is a grip element configured to engage a user's hand. The grip element can include a grip interior surface and a grip exterior surface. The grip interior surface can face and can be adjacent the outer polymeric layer of the aerogel. In some cases, and in some locations, the grip interior surface can be separated from the outer polymeric layer by a gap so that the grip interior surface does not abrade or excessively engage against the aerogel to prolong its useful life.

In a further embodiment, the weapon can be an archery bow having a riser. The riser can include a riser grip area including a first riser surface. A first layer comprising an aerogel can be adjacent the first riser surface. A grip can be disposed over the first layer in the riser grip area. The grip can include an exterior grip surface that can engage a user's hand when the user holds the archery bow.

In still a further embodiment, the riser grip area defines a first recess. The first riser surface can form a bottom of the first recess. The first layer of aerogel can include an inner surface that is adhered directly to or placed adjacent the first riser surface. The grip can include a first grip interior surface adjacent which an outer surface of the aerogel can be positioned.

In still a further embodiment, the riser grip area can include multiple recesses having multiple riser surfaces in forming the bottoms thereof. Multiple individual and separate pieces of aerogel layers can be located and precisely positioned in the respective recesses, with the inner surfaces of those aerogel pieces disposed against the riser surfaces in the recesses.

In yet a further embodiment, the riser grip area can include a spacer or shoulder that is located adjacent the respective recesses. The spacer can be of a height that is equal to or greater than a thickness of a corresponding aerogel layer placed in the recess. The grip element can be placed over the aerogel layer and the spacer such that the interior surface of the grip engages the spacer.

In even a further embodiment, the grip is secured to the riser with one or more fasteners. The fastener can project through the grip and into a hole defined in the spacer or riser. When tightened, the fastener can draw the interior surface of the grip against the spacer. Due to the spacer being thicker than the thickness of the aerogel layer, however, the spacer can prevent the aerogel layer from being crushed under the force of the fastener as the fastener is tightened. In turn, this can preserve the structure and insulation properties of the aerogel layer.

In still a further embodiment, the weapon can include a user engagement area. That area can be any one of a butt stock, a cheek member, a fore end, a handguard and a grip of a firearm. An aerogel can be included in the area to impair thermal energy transfer between the user and the weapon.

The current embodiments provide a grip for a weapon with excellent insulation properties to impair transfer of thermal energy between the weapon and the user. In turn, a user can grip the weapon for longer periods in cold environments without the weapon acting as a heat sink, promoting cold and loss of dexterity in the user's appendage.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

A current embodiment of the grip and a weapon of a current embodiment is shown in FIGS. 1-4 and generally designated 10. The grip 10 is shown installed on a weapon, which is shown as an archery bow 100. The archery bow can be a compound archery bow, however, the grip 10 is well suited for other types of bows, such as recurve bows, long bows, crossbows and other devices from which arrows or bolts can be shot. The grip 10 optionally can be used with other types of weapons, for example, it can be mounted to other types of firearms, including but not limited to a rifle (for example, a long rifle, a carbine, an assault rifle, a bolt pump rifle or a battle rifle); a shotgun (of any gauge) and/or a machine gun (for example, a machine pistol, a light machine gun, a mini gun, a medium machine gun or a heavy machine gun). The firearm can include any type of action, for example, bolt action, lever action, pump action and/or break action. The firearm can be single shot, automatic and/or semiautomatic. Further optionally, the weapon can be in the form of equipment such as paint ball markers and air rifles such as bb guns, air soft guns and/or pellet guns.

Figure 1:
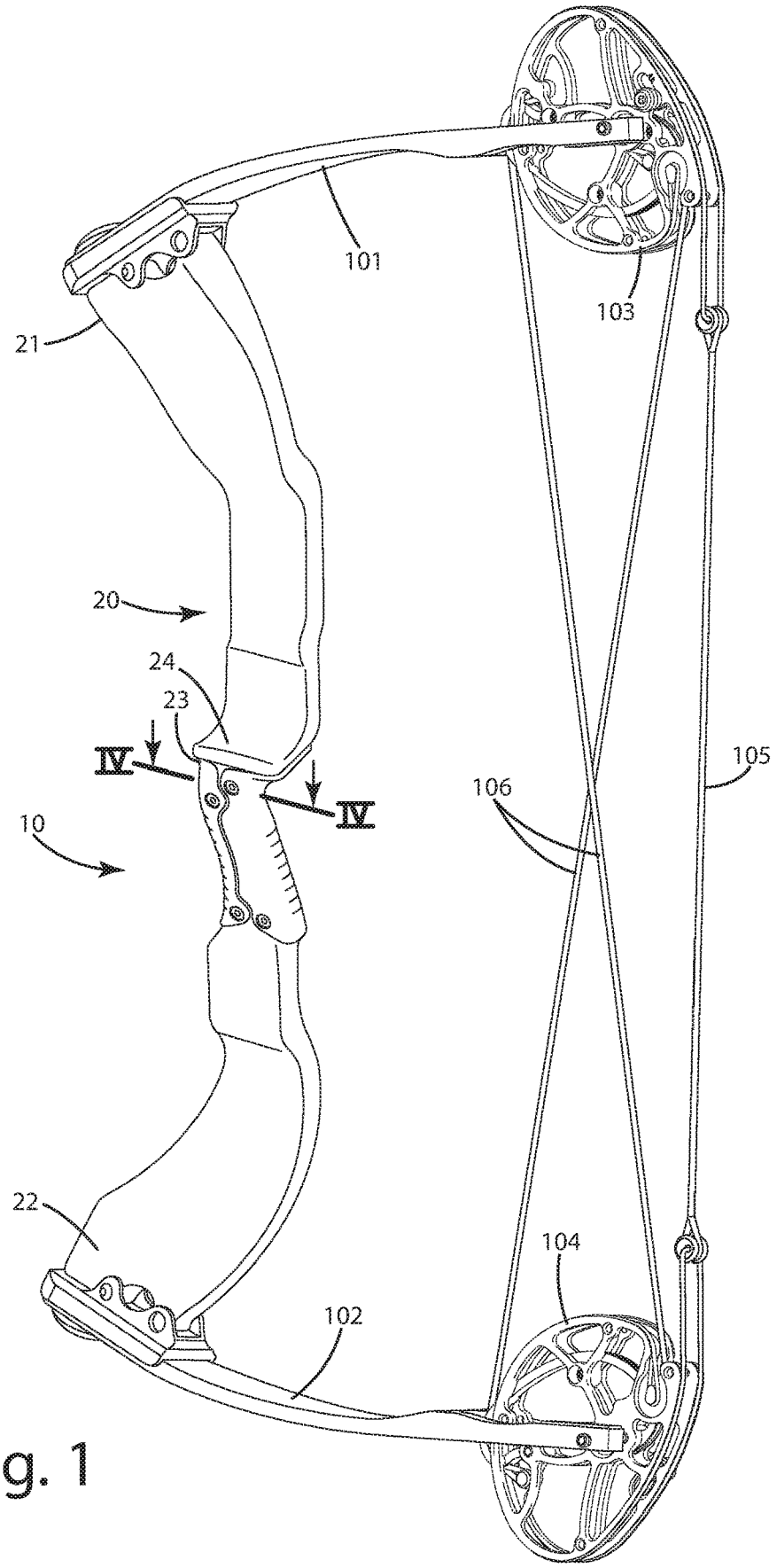
FIG. 1 is a perspective view of a weapon, in the form of an exemplary archery bow, including the grip of a current embodiment.

Returning to the archery bow 100 shown in FIG. 1, that bow can include a riser 20 including first end 21 and a second end 22. A first limb 101 can be joined with the first end 21, and a second limb 102 can be joined with the second end 22. The limbs can support rotating cams 103 and 104 respectively, between which a bowstring 105 extends. The cams also can be operably coupled to power cables 106, which govern rotation of those cams when the bow is drawn and/or used to propel an arrow.

The riser 20 includes a riser grip area 23 disposed between the first end 21 and the second end 22, generally about midway between the same. The riser grip area can be disposed under a shelf 24 over which an arrow (not shown) is typically located before shooting that arrow. The riser grip area, also referred to as a user engagement area, can be that location along the riser where a user can manually grasp and/or hold the bow when drawing or shooting the same. The riser grip area 23 can include a first surface to which the grip 10 is generally joined or adjacent which the grip is located.

Figure 2:
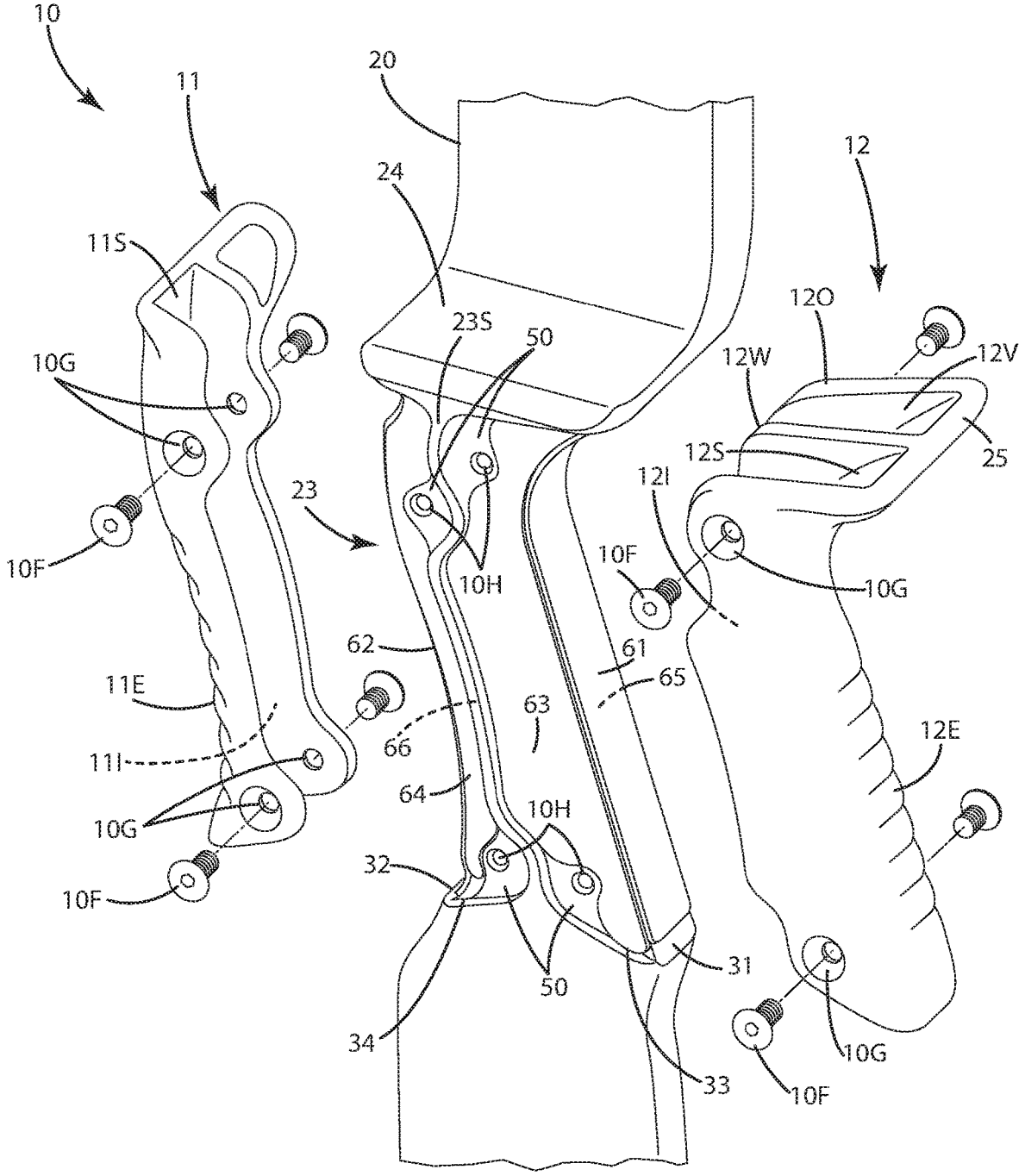
FIG. 2 is a perspective close-up, exploded view of the grip.

As illustrated in FIG. 2, the grip 10 can include one or more components, for example, a first grip member 11 and a second grip member 12. The first grip member can be in a forward portion of the riser grip area 23, and the second grip member can be in a rearward portion of the riser grip area 23. The first and second grip members can be separate and independent units that can be applied to and/or installed on or relative to the riser grip area 23. Optionally, in other embodiments as described below, the grip can include a single member that is applied to the riser grip area mostly from the rearward portion of the riser.

As shown in FIG. 2, the first grip member 11 and second grip member 12 are elongated U or V shaped elements that face one another and are located on opposite sides of the riser, for example, the front and rear of the riser. Optionally, in other constructions the grip members can be opposite one another on opposing left and right sides of the riser. Generally, the second grip member can cover more of the grip riser area 23 than the first member, to provide a greater contiguous engagement area for a user's palm and hand that engages that second grip member. The second grip member 12 optionally can include an extension 25 that extends from an upper portion of the member 12 laterally on one side of the grip. This extension can wrap and transition under the shelf 24 of the riser to provide a smooth and comfortable grip surface there for the user's hand. The extension 25 can be separated from a slot 12S within which a portion of the riser fits, via a wall 12W that is disposed inward from an outer wall 120 of the extension 25. A secondary void 12V also can be formed between the walls 12W and 120 in the extension in some applications. In others, that void can be filled, and in yet others the extension can be absent altogether.

The first and second grip members can be secured to the riser grip area and the riser in general in a variety of ways. For example, those grip members can be fastened with fasteners, glued, cemented, bonded, fused, coated or otherwise applied and joined to the riser. As shown, the grip members are secured with fasteners 10F. These fasteners can be threaded, and can be received in corresponding threaded holes 10H defined by the riser in the riser grip area 23 or generally in the user engagement area. These fasteners can include chamfered or angled heads that can fit in corresponding tapered holes 10G in the grip members so the heads are flush or below an outer or exterior surface of the grip members. Optionally, two fasteners 10F can be disposed on the left and right sides of each of the grip members for a total of eight fasteners securing the grip and its members to the riser. Of course, more or fewer fasteners can be used depending on the application and the layout of the grip members and grip.

As mentioned above, the grip members themselves can define slots 11S and 12S so that they can interfit over portions of the riser. In some applications, the slots can be U or V shaped for this purpose. In other applications, the grip members can be L-shaped or planar, can be engaged with a corner or flat surface or recess of the riser in the riser grip area. In yet other applications (not shown), the grip members can be a full, rounded component that circumferentiates the riser in the riser grip area. In that case, the grip members can be connected as one piece, with a slit or opening down one portion. That slit can be opened or widened so that the riser can be inserted into an opening of the grip 10. After insertion, the opposing members of the grip can be released so that the grip frictionally fits against or is secured to the grip riser area.

Each of the grip members 11 and 12 can include an exterior grip surface 11E and 12E respectively that are configured to engage a hand of a user when the user holds the weapon 100. The exterior grip surfaces can be contoured and/or texturized to promote proper and satisfactory grip of the grip 10 and thus of the weapon 100. In some cases, the grip members can be constructed from rubber, silica, wood, Delran(R), composites, TPE (thermoplastic elastomer), other polymers and/or other materials. In some cases, the grip members can include an inner hard plastic or polymeric layer, and an outer, hand engaging layer of silica or TPE, which can be more grippy, tacky or textured to promote grip thereof. Opposite the exterior surfaces can be interior surfaces 11I and 12I of the respective grip members. These surfaces can bound the voids of the respective grip members and can generally face the riser grip area when the grip members are installed. Optionally, the grip member holes 10G can extend through the grip members from the exterior surface to the interior surface.

Figure 3:
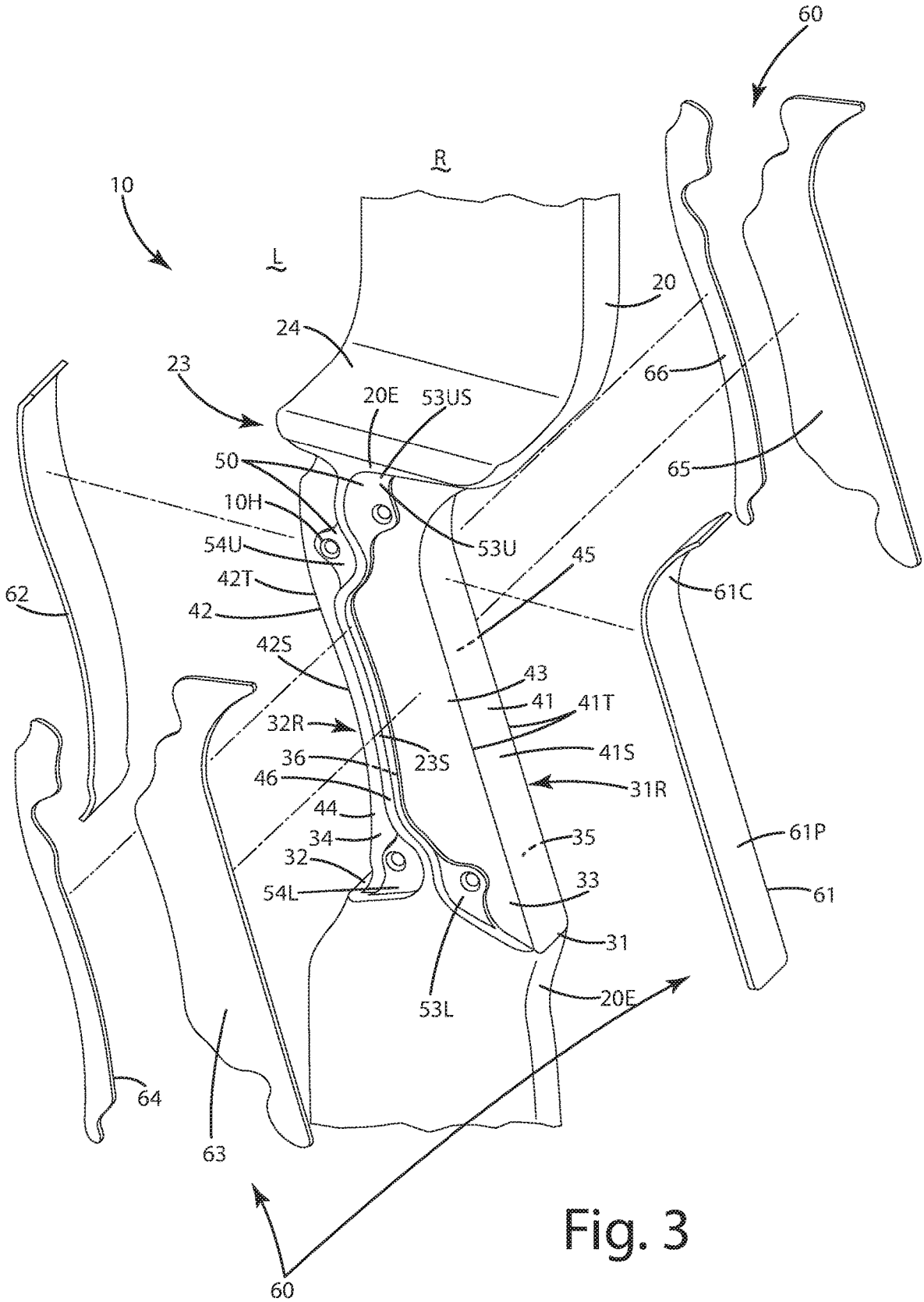
FIG. 3 is a perspective close-up further exploded view of the grip.

Turning to FIG. 3, the riser grip area 23 can include one or more recesses that can be recessed from an exterior surface 20E of the riser 20. For example, the user engagement area or riser grip area 23 can define a first recess 31 on a rear portion of the riser and a second recess 32 on the front portion of the riser. The first recess 31 can transition to lateral recesses 33 and 35, and the second recess 32 can transition to lateral recesses 34 and 36, The recesses 31, 33 and 35 can be covered substantially by the second grip member 12. The recesses 31, 33 and 35 can collectively form a rearward recess 31R. The recesses 32, 34 and 36 can be substantially covered by the first grip member 11. The recesses 32, 34 and 36 can collectively form a forward recess 32R.

The different recesses can include different riser surfaces. For example, the rearward recess 31R can include a first riser surface 41S and the forward recess 32R can include a second riser surface 42S. The first riser surface can comprise other riser surfaces, such as a rear surface 41, and lateral surfaces 43 and 45, while the second riser surface can comprise other surfaces, such as a front surface 42, and lateral surfaces 44 and 46.

Optionally, these surfaces can form the bottoms of the respective recesses. Further optionally, the surfaces can join one another at respective corners or transitions. For example, rear surface 41 can transition at corners 41T (which can be rounded, angled, or contoured) to side surfaces 43 and 45. For example, front surface 42 can transition at corners 42T (which can be rounded, angled, or contoured) to side surfaces 44 and 46.

As shown in FIG. 3, the riser grip area 23 optionally can include a separator ridge or boundary 23S that separates the front and rear recesses 31R and 32R. This separator ridge 23S can be located on opposing lateral sides L and R of the longitudinal axis of the riser 20. The separator ridge also can have an exterior surface common to and coextensive with the riser exterior surface 20E. The separator ridge 23S also can vary in contour and layout as it transitions upward and downward bounding the respective front and rear recesses.

With further reference to FIG. 3, the riser grip area optionally can include one or more spacers or shoulders 50 within or adjacent the respective recesses 41 and/or 42. The spacers as shown are adjacent and extend from the separator ridge 23S, but of course can be distal from and separate from the separator ridge in other applications. The spacers can prevent or impair inadvertent crushing or deleterious engagement of the grip members 11 and 12 with one or more aerogel layers 60, in the form of separate units or parts that are placed in the recesses as described below. For example, the spacers 50 can be of a height H that is equal to or greater than a thickness T of a corresponding aerogel layer 60 placed in the recess. The grip element 11, 12 can be placed over the aerogel layers 60 in the respective recesses, and the over the spacer such that the interior surfaces 11I, 12I of the grip members engages the spacers 50.

Figure 4:
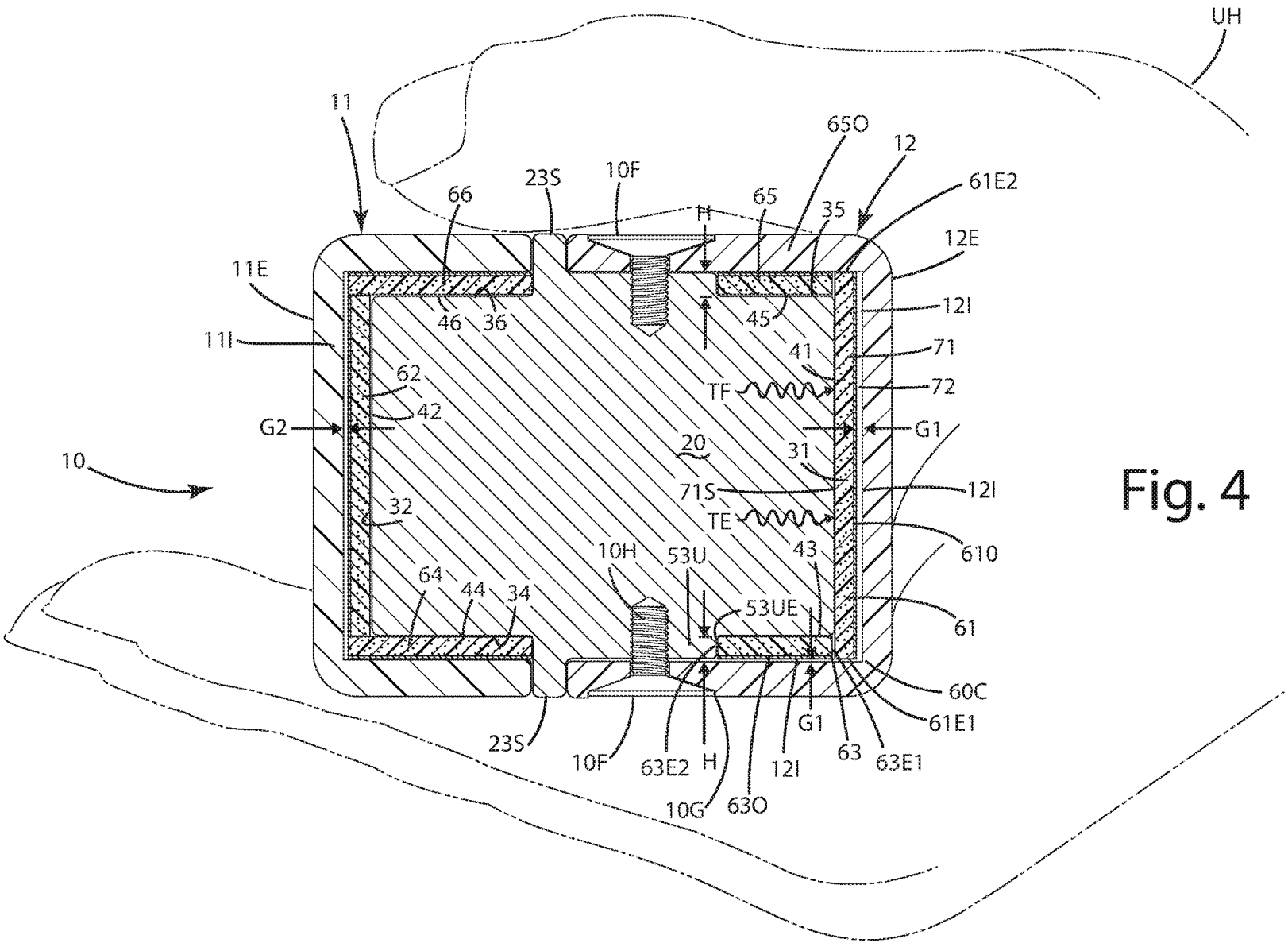
FIG. 4 is a section view of the grip on the weapon taken along line IV-IV of FIG. 1.

Referring to FIGS. 3 and 4 with more particularity, the spacers 50 can include upper spacers 53U and 54U, and lower spacers 53L and 54L. These spacers can project out into the adjacent respective recesses. As an example, upper spacer 53U and lower spacer 53L can project into recess 33, and can then transition toward the bottom or side surface 43 of that recess, optionally at an edge, corner or transition area 53UE and 53LE respectively. One or more of the spacers can include spacer bearing surfaces. This bearing surface can engage directly the interior surface of the respective grip members 11 and 12. For example, the spacer 53U can include a spacer bearing surface 53US that can directly engage the interior surface 12I of the grip member 12. These spacer bearing surfaces are located the height H above the bottom of the adjacent recess, for example recess 33. As will be appreciated, the other spacers of the grip can be similarly structured and can operate similarly to the spacer described above.

The spacers again can be operated to protect or limit compression or engagement of the aerogel layers with the respective grip members when secured to the riser. Optionally, the grip 10 and the respective grip members 11 and 12 can be secured to the riser 20 with one or more fasteners 10F.

These fasteners can project through the respective grip elements via grip holes 10G defined by those members. The fasteners can project further into a hole 10H defined in the spacer and riser. The holes 10G and 10H can be aligned with one another. When tightened, the fasteners 10F can draw the grip elements toward the riser. For example, the fasteners can draw the interior surfaces 11I and 12I against the spacers. As shown in FIG. 4, the interior surface 12I can be drawn and urged into engagement with the spacer 53U, with that interior surface engaging and contacting the bearing surface 53UE directly. The heads of the fasteners can further engage the grip members to hold and/or urge them in place against the riser and the spacers in particular.

The spacer height can have a particular ratio relative to the thickness of the aerogel layers. As shown in FIG. 4, the aerogel layer unit 63 can include a thickness T. The spacer 53U can have a height H. The height H can be greater than the thickness T. For example, the ratio of the height to the thickness can be optionally greater than 1:1, greater than 1:1.5, or greater than 1:2. Due to the spacer height being greater than the thickness of the aerogel layer, the spacer can act as a stop, and can prevent the underlying aerogel layer from being crushed under the force of the fastener 10F as the fastener is tightened into the hole 10H of the riser. In turn, this can preserve the structure and integrity of the aerogel layers, and of course, their insulation properties as discussed below.

Optionally, the difference in the height H relative to the thickness T also can produce a gap between the grip members and the aerogel layers. In some cases, the grip interior surface 11I, 12I can be adjacent the respective aerogel layer but might not touch, contact or engage that layer. Accordingly, a gap can be present between these elements, and this gap can optionally prevent or impair thermal energy transfer between the riser and a user's hand holding the grip. For example, as shown in FIG. 4, the grip interior surface 12I can be separated from the outer surface 63O of the aerogel layer 63 by a gap G1. The grip interior surface 12I also can be separated from the outer surface 61O of the aerogel layer 61. Likewise, that surface 12I can be separated from the outer surface 65O of the aerogel layer 65. A similar gap G2 can be formed between the aerogel layers 62, 64 and 66 in the forward recess and the interior surface 11I of the grip element 11 where included. In some applications, this gap can be optionally less than 5 mm, less than 4 mm, less than 3 mm, less than 2 mm, less than 1 mm, less than 0.5 mm, or less than 0.2 mm. In other applications, this gap can be zero, and the interior surface can directly engage the outer surface of one or more of the aerogel layers.

With further reference to FIGS. 3 and 4, the aerogel layers 60 can comprise multiple units, such as a first or rear aerogel layer 61, a front aerogel layer 62, and respective side aerogel layers 63-66. These aerogel layers can be disposed in the respective recesses of the user engagement area, and can extend up to the respective spacers and the separator ridge, terminating adjacent those elements. As shown, the side or lateral aerogel layers 63-66 can be substantially planar, even when disposed in the respective recesses. The first or rear aerogel layer 61, however, can include a planar portion 61P in a lower portion and a curve or angled portion 61C in an upper portion of the aerogel layer 61. The second or forward aerogel layer 62 can include planar and curved portions as well. Generally, the various aerogel layers of the grip can be void of any bends, folds or corners that render two adjacent and contiguous portions of a unitary piece of an aerogel layer at an angle optionally less than 180 degrees, less than 150 degrees, less than 120 degrees, or less than 90 degrees, inclusive for all the foregoing values. In some applications, with the layers being void of such bends and folds, the aerogel layers maintain their integrity and are less likely to crack, shatter or otherwise become damaged.

Each of the aerogel layers can abut or be adjacent one another around the riser grip area. For example, the rear or first aerogel layer 61 can include a first edge 61E1 and a second edge 61E2. The first edge can be disposed adjacent and in some cases contacting a first edge 63E1 of the aerogel layer 63. This adjacency can occur at a corner or transition 60C between one aerogel layer and another. The other second edge 63E2 of the aerogel layer 63 can be disposed adjacent the edge 53UE of the spacer or the edge of the separator ridge 23S when included.

The aerogel layers 60 used in the grip area can be custom cut and formed to fit the various recesses or otherwise be secured to or near a user engagement area or riser grip surface. Accordingly, although the aerogel layers are shown in a particular configuration and shape, a variety of other shapes and configurations can be implemented.

The various aerogel layers 60 are constructed from one or more materials having unique properties. Generally, the aerogel layers comprise an aerogel, which is an open-celled, mesoporous, solid foam comprising a network of interconnected structures. The foam can exhibit a porosity or non-solid volume of optionally greater than 50%, greater than 60%, greater than 70%, greater than 80%, greater than 90%, greater than 95%, or greater than 99% inclusive for all the foregoing values. The aerogel layer can have a density of optionally less than 2 g/cm$^3$, less than 1 g/cm$^3$, less than 0.5 g/cm$^3$, or less than 0.1 g/cm$^3$, inclusive for all the foregoing values. The aerogel of the aerogel layer can be a foam that comprises optionally at least 80% gas, at least 90% gas or at least 95% gas, inclusive for all the foregoing values.

Optionally, the aerogels used in the aerogel layers can be silica aerogels. These can have ultralow thermal conductivity (as low as 10 mW/mK), extremely low density (as low as 0.001 g/cm$^3$), high specific surface area (500-2000 m$^2$/g), low dielectric constant (as low as 1.02), and good optical transparency (~91% per cm). Other suitable aerogels can be made from metals, such as transition metal oxides, lanthanide oxides, actinide oxides, main group oxides, and mixed matrix oxides, polymers, such as phenolics, polyureas, polyurethanes, polyimides, and/or polyamides, and carbon, such as amorphous carbon, graphitic carbon, carbon nanotubes and graphene. Further optionally, the aerogels of the aerogel layers can have a dendritic microstructure, in which spherical members of average size 2-5 nanometers are fused together into clusters. These clusters can form a three-dimensional highly porous foam like structure with pores optionally under 100 nanometers.

The aerogel layers can include aerogels in the form of a flexible aerogel thin film. Of course, aerogel meshes, monoliths, composite blankets or other forms are contemplates. In its film form, the aerogel layer can include a first or base layer 71, which can be the open-celled, mesoporous, foam layer comprising a network of interconnected structures, as shown in FIG. 4. That first or base layer 71 can be joined with a polymeric layer 72. That layer can generally cover, protect and/or lay over the base layer 71. The polymeric layer can be of a lesser thickness than the base layer, and can be disposed exterior and farther away from the riser than the base layer. In some cases, the aerogel layer can include a second surface 71S opposite the outer polymeric layer. The foam layer and interstitial spaces of the aerogel can be exposed at the second surface. The second surface 71S can be tacky and can exhibit some levels of adhesion. Optionally, the tackiness of the aerogel layer itself, free from any additional adhesive, glue or cement, can join the aerogel layer with the riser grip surface, and/or with the various first, second, third surfaces etc. of the riser in the recesses is included. The outer polymeric layer can be disposed between the first or base layer and the grip members as shown. As an example, the polymeric layer 72 can be between the first or base layer 71 of the aerogel and the interior grip surface 12I. In this case, the exterior surface of that polymeric layer also can be separated by a gap G1 from the interior grip surface 12I. Of course, the other aerogel layers 62-66 can be similarly constructed and situated relative to the riser components and the respective grip members.

Optionally, in some cases a second or inner polymeric layer can be disposed over the second surface of the base layer as a protective layer. Further optionally, the second surface of the base or first layer can be secured to the adjacent riser surface 41. This can be accomplished via the tacky property of the base layer, and/or by an adhesive, cement or other tacky coating disposed between the inner or second surface of the aerogel layer and the riser surface. Indeed, the various different aerogel layers 61-66 can be secured to the riser engagement area in a similar manner, so that they do not move around in or become loosened from the respective recesses and riser surfaces.

The grip 10 of the current embodiment as shown in FIG. 4, with the aerogel layers 60 incorporated into the grip, can impair thermal energy TE transfer between the user and the weapon, and in particular, the riser 20 as shown. The aerogel acts as an insulation layer to impair cold thermal energy from transferring to the user's hand UH, and conversely, from the warmth or heat thermal energy from being sunk into the riser from the user's hand, which again can be constructed from metal, composites and the like. As used herein, impair in its various forms means to prevent, reduce, cease, lessen, diminish and/or decrease. Accordingly, the user's hand is insulated from the heat sink of the riser, such that the user's hand can stay warm or generally does not become cold due to contact or engagement with the grip 10 that is joined with a riser or other part of the weapon in a cold environment.

Figure 5:
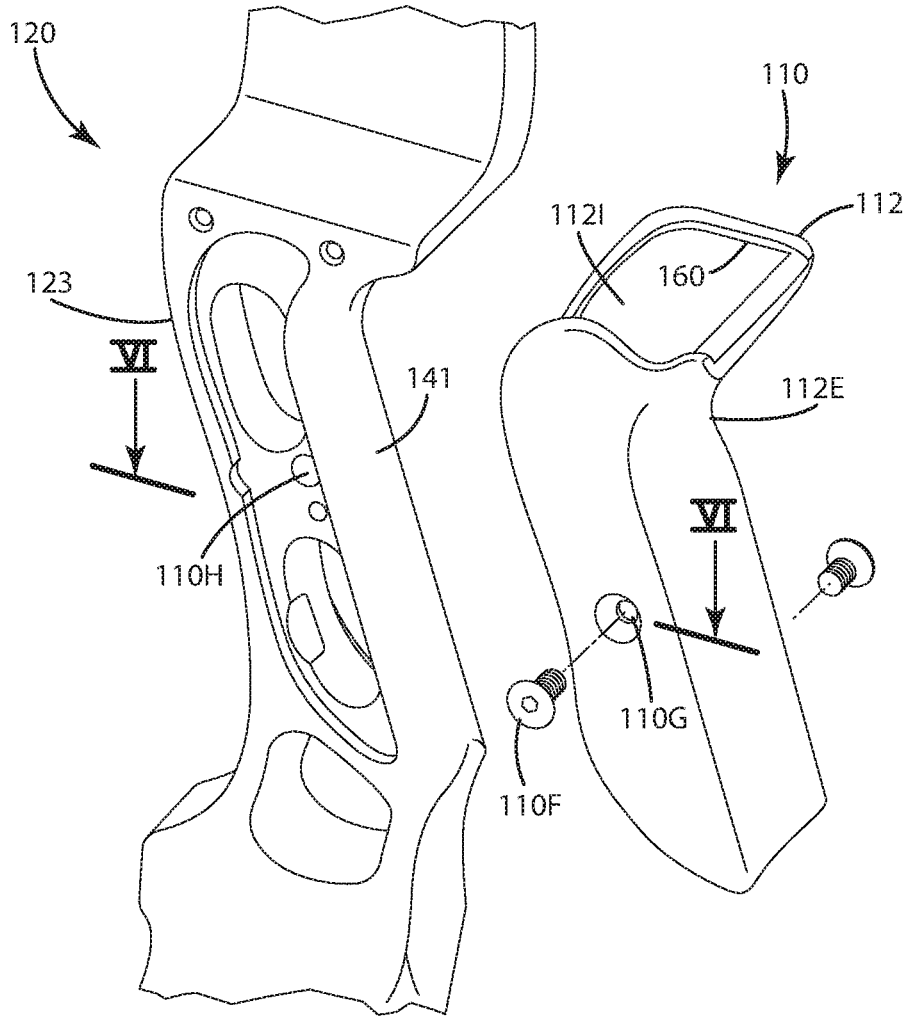
FIG. 5 is a perspective view of a grip of a first alternative embodiment being applied to an exemplary archery bow.
Figure 6:
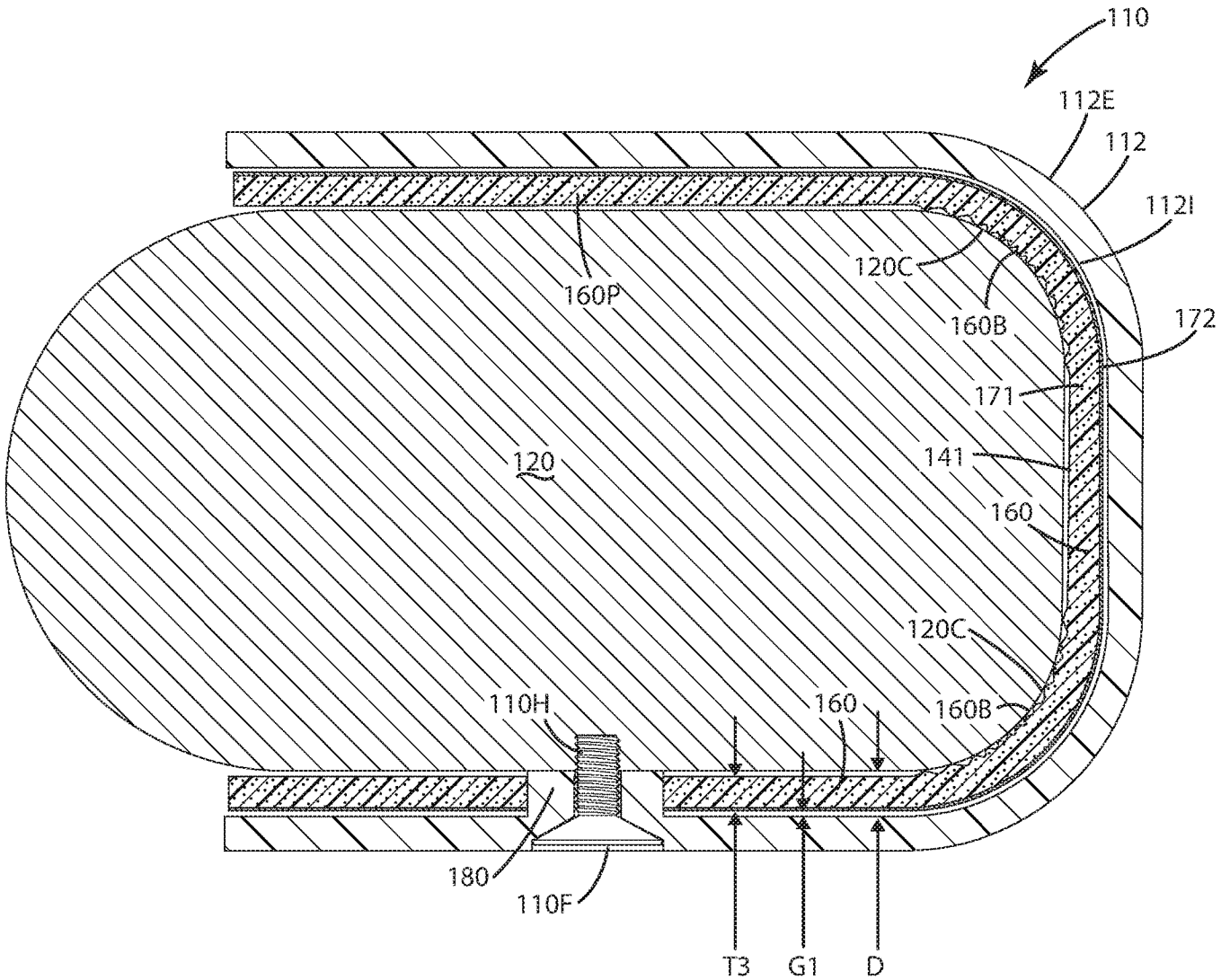
FIG. 6 is a section view of the grip taken along line VI-VI of FIG. 5.

A first alternative embodiment of a grip is shown in FIGS. 5-6 and generally designated 110. The grip 110 is similar in structure, function and operation of the grip of the embodiment above with several exceptions. For example, the grip 110 is secured to a riser 120, and in particular a riser grip area 123 via fasteners 110F that extend through grip holes 110G and are threaded into riser holes 110H. The grip 110 includes a grip member 112, having an interior 112I and an exterior 112E. An aerogel layer is placed adjacent the first riser surface 141. This surface can be contiguous around the rearward portion of the riser. The aerogel layer can include a base or first layer 171 of the aerogel material and a polymeric exterior layer 172.

The aerogel layer in this embodiment can be bent, folded, contoured and/or made nonplanar (interchangeably referred to as bent) around a corner or contour 160B of the riser. The amount of bending however can be limited so that the aerogel layer is not substantially damaged, and so that it can maintain a majority of its insulation properties relative to an unbent or planar section 160P of the layer 160.

Optionally, the aerogel layer 160 can be spaced by a gap G-3 from the interior grip surface 112I. This gap can be similar to the gap G1 described above. In some cases, near the corners 120C of the riser, the aerogel layer be spaced a second gap G4 or distance from the face 141 as well.

As shown in FIG. 6, the gap G3 can be established via an inward projection 180 associated with the grip member 112. In particular, the grip member 112 can include an interior surface 112I. The inward projection 180, which is shown in the form of a boss projecting inward from that surface, can directly engage the riser in the riser grip area 141. By way of this engagement, the inward projection can establish a first distance D between the riser grip surface 141 and the interior surface 112I of the grip member 112. The first layer 160 including the aerogel layer can be placed between the riser surface 141 and that interior grip surface. The aerogel layer can include as thickness T3. This thickness T3, however, can be less than the first distance D. As a result, the gap G3 can be established between the aerogel layer 160 and the grip member, or in some cases between the aerogel layer and the riser surface. This extra gap can ensure that when the fastener is tightened, the aerogel layer is not crushed or damaged, thereby preserving the insulation properties of that layer.

Although a single inward projection or boss 180 is shown in one location on the interior of the grip 112, additional inward projections can be included inside the grip, in a variety of locations, to engage the riser and act as a stop or a limiter when a fastener is tightened to prevent damage to the aerogel layer.

Figure 7:
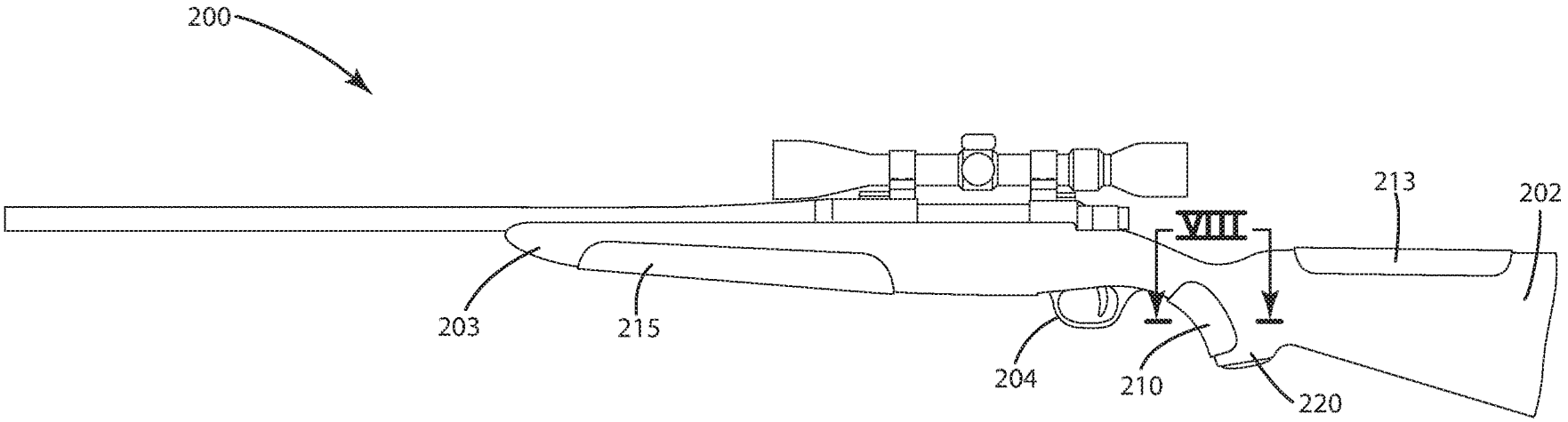
FIG. 7 is a perspective view of a weapon, in the form of an exemplary firearm, including a grip of a second alternative embodiment.
Figure 8:
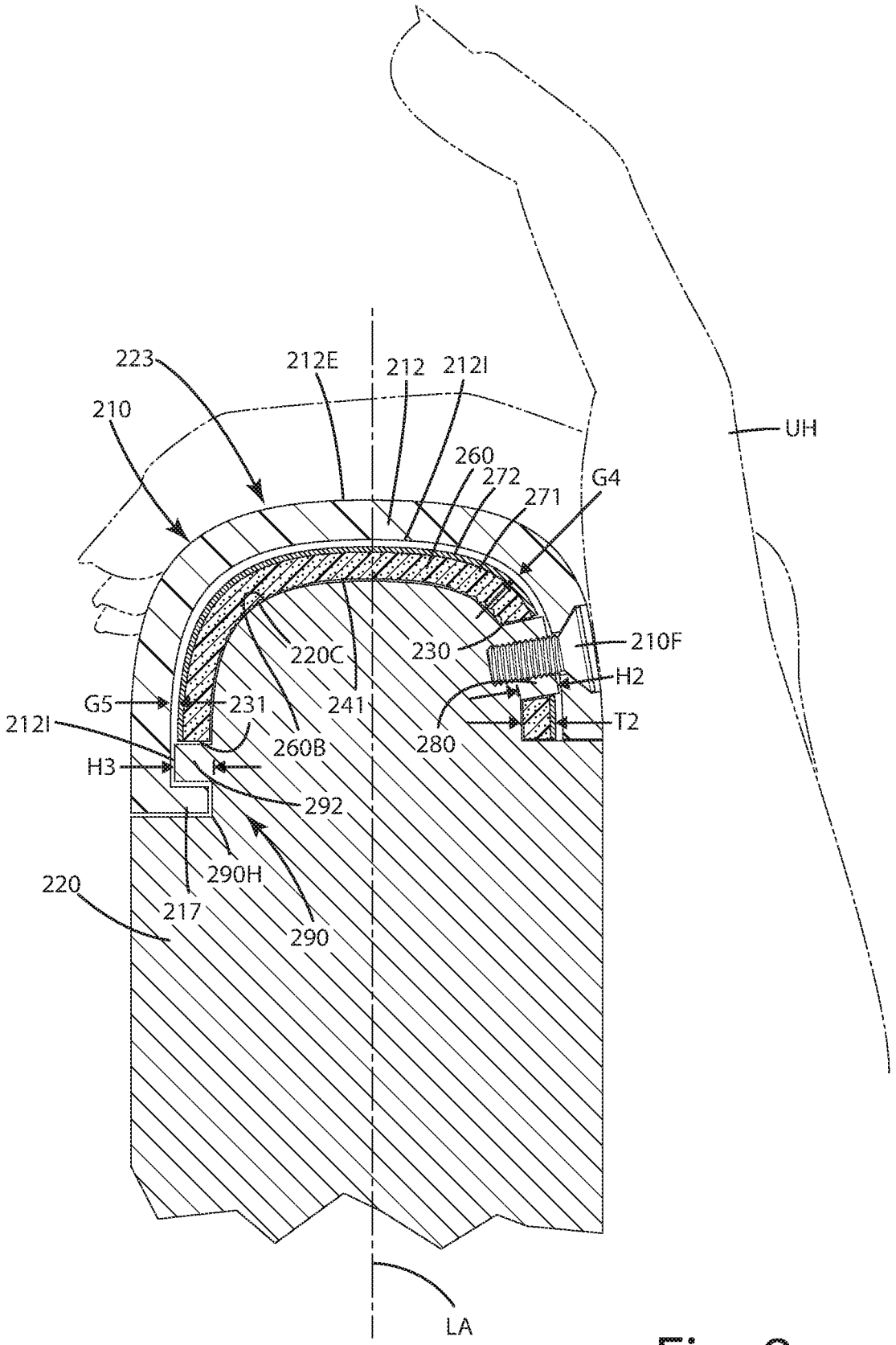
FIG. 8 is a section view of the grip taken along line VIII-VIII of FIG. 7.

A second alternative embodiment of a grip is shown in FIGS. 7 and 8. In this embodiment, the grip can be implemented in various portions of a firearm. The grip, however, is similar in structure, function and operation of the grip of the embodiments above with several exceptions. For example, the grip can include a user engagement area and can be disposed in any one or more of multiple locations on the firearm when a user might engage an appendage against that firearm. As used herein, appendage is recant to include a hand, an arm, a leg, a cheek etc. The user engagement area can be disposed on or adjacent any one or more of the butt stock, a cheek member, a fore end, a handguard and a grip of a firearm.

For example, as shown in FIG. 7, the grip can be implemented as a cheek member or comb 213 at a butt stock 202 of the weapon or firearm 200, as a secondary grip 215 or part of a fore end or handguard 203 and/or as a primary grip 210 on the stock or grip 220 adjacent a trigger 204 of the firearm 200. Each of these grips can be configured and constructed similar to the grips 10 and 110 described above, and can be joined with the firearm in a similar manner as the grips are joined with the archery bow 100.

Of course, the grips can be constructed slightly differently, and attached in a different manner. One of the grips 210 and its attachment will be described here, but it is to be noted that the other grips 213 and 215 can be constructed and attached to other user engagement areas on the weapon in a similar manner. The grip 210 is shown as being located adjacent a trigger 204 of the firearm. That location can be one where a user grasps the weapon with the user's hand UH for extended periods while holding and/or aiming the firearm 200. As shown in FIG. 8, that grip 210 can include a user engagement area 223 including a first surface 241 on the weapon, and in particular on the grip or stock 220. The grip 210 can include a first layer or aerogel layer 260 comprising an aerogel. The first layer 260 can be disposed adjacent the first surface 241. A first engagement member or first grip member 212 can be disposed over the first layer in the user engagement area. That first engagement member or first grip member 212 can include an exterior surface 212E that can be contacted by and engaged by an appendage of a user when the user holds the weapon, as shown, the user's hand UH can grasp the grip or stock 220 there.

Of course, with regard to the other grips 213 and 215, other appendages of the user such as the user's other hand and/or cheek can engage those respective grips. As with the embodiments above, the first layer insulates the first engagement member to reduce thermal conductivity of the grip 210 so that thermal energy transfer between the user and the weapon is impaired. As a result, if the grip or stock or weapon in general is cold, the grip 210 impairs the weapon and its components from being a significant heat sink, and impairs the weapon from pulling thermal energy from the user to make the appendage become cold.

With further reference to FIG. 8, the aerogel or first layer 260 can be similar in construction to the embodiment above. For example, it can include a base layer 271 which can be aerogel material having the features and physical properties as mentioned above. The base layer 271 can be covered by a cover or polymeric layer 272. The polymeric layer can be adjacent the interior surface 212I of the grip member 212, generally between it and the first surface 241 of the grip 220. The aerogel layer can be bent around the contours of the first surface as shown, transitioning around the contours 220C at respective bends 260B. Optionally, the aerogel layer can be separated into independent parts similar to the construction shown in FIG. 4, with the different aerogel layers meeting at edges adjacent the contours 220C.

The aerogel layer can be positioned in a recess 231 defined by the user engagement area. The recess can extend from one side of the weapon to the other, across a longitudinal axis LA thereof. The grip member 212 can be placed over the aerogel layer 260 to trap that aerogel layer in the grip 210. In some applications, the grip member and aerogel layer can be joined with one another, for example, with an adhesive, cement, tape or fasteners. The grip member and its interior surface 212I also can be spaced a distance to form a gap G4 between the aerogel layer and the interior surface to protect the aerogel layer. The gap G4 can be similar to the gaps in the embodiments above.

Optionally, the gap G4 can be established via a boss or projection 280 that projects from the first surface 241. The projection 280 can define a threaded hole to receive a fastener 210F that secured the grip member to the grip 210. The projection 280 can be of a height H2 that is greater than a thickness T2 of the aerogel layer 260. Thus, when the fastener is tightened, the interior surface 212I engages a bearing surface of the projection and the projection prevents the grip member from coming any closer to the first surface than the height H2. The aerogel can be spaced from the interior surface 212I by a distance corresponding to the gap G4. Of course, distal from the projection, the gap can decrease in size, and in some cases, the interior surface 212I can engage the aerogel layer, for example on the polymeric layer 272.

An alternative attachment of the grip member to the grip 220 is shown at 290. There, the grip defines a recess or slot 290H. The grip member includes a finger 217. A projection or shoulder 292 projects above the first surface 241 a height H3, which can be greater than or equal to the thickness T2 of the aerogel layer. The finger can fit in the slot or recess 290H to secure the grip member to the grip 220. The projection can engage the interior surface and can maintain that surface the height H3 away from the first surface 241. The gap G5 can be established between the aerogel layer and the interior surface. Of course, the gap can be zero in some cases, with the interior surface against the aerogel layer. Optionally, the attachment 290 can be duplicated on the opposite side of the grip 220, so that the grip member snaps into place fingers in recesses on opposite sides of the grip.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, member or layer is referred to as being "joined with," "on," "engaged with," "adhered to," "secured to," or "coupled to" another component, member or layer, it may be directly joined with, on, engaged with, adhered to, secured to, or coupled to the other component, member or layer, or any number of intervening components, members or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and members should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without demembering from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow comprising:

a riser including first end and a second end;

a first limb joined with the first end;

a second limb joined with the second end;

a bowstring extending between the first limb and the second limb;

a riser grip area disposed between the first end and the second end, the riser grip area defining a first recess on a rear of the riser, the riser grip area including a first riser surface;

a first layer comprising an aerogel, the first layer disposed in the first recess adjacent the first riser surface in the riser grip area; and a first grip member disposed over the first layer in the riser grip area, the first grip member including a first exterior grip surface configured to engage a hand of a user when the user holds the archery bow.

2. The archery bow of claim 1, wherein the aerogel is an open-celled, mesoporous, solid foam comprising a network of interconnected structures, the foam exhibiting a porosity or non-solid volume of greater than 50%.

3. The archery bow of claim 1, wherein the riser grip area includes a spacer associated including a spacer bearing surface, wherein the spacer engages the first grip member in the riser grip area.

4. The archery bow of claim 3, wherein the spacer stablishes a first distance between the riser grip surface and the interior surface of the grip member, wherein the first layer includes a first thickness, wherein the first thickness is less than the first distance.

5. The archery bow of claim 4, wherein the first layer includes an outer polymeric layer, wherein the outer polymeric layer is disposed between the first layer and the grip member.

6. The archery bow of claim 1, comprising:

a second layer comprising the aerogel disposed in a second recess defined in the riser grip area; and a second grip member disposed over the second layer in the riser grip area including a second exterior grip surface configured to engage the hand of a user when the user holds the archery bow, wherein the first grip member faces rearward of the riser and the second grip member faces forward of the riser.

7. The archery bow of claim 1 comprising:

a first fastener; and a first boss extending inward from the first grip member, wherein the first fastener engages the riser to urge the first boss against the first riser surface.

8. The archery bow of claim 7, wherein the first boss defines a first hole, wherein the first fastener extends through the hole, wherein the first boss establishes a distance between the first riser surface and a first grip interior surface, wherein the first layer includes a first thickness, wherein the first thickness is less than the first distance.

9. The archery bow of claim 1, wherein the aerogel has a density of less than 0.1 g/cm$^3$.

10. The archery bow of claim 1, wherein the aerogel is a foam and comprises as least 95% gas.

11. An archery bow comprising:

a riser including first end and a second end;

a first limb joined with the first end;

a second limb joined with the second end;

a bowstring disposed between the first limb and the second limb;

a riser grip area disposed between the first end and the second end, the riser grip area including a first riser surface;

a first layer comprising an aerogel, the first layer disposed adjacent the first riser surface; and a first grip member disposed over the first layer in the riser grip area, the first grip member including an exterior grip surface configured to engage a hand of a user when the user holds the archery bow.

12. The archery bow of claim 11, wherein the aerogel is an open-celled, mesoporous, solid foam comprising a network of interconnected structures, the foam exhibiting a porosity or non-solid volume of greater than 50%.

13. The archery bow of claim 12, wherein the riser grip area defines a first recess, wherein the first riser surface forms a bottom of the first recess, wherein the first layer comprising the aerogel includes an inner surface that is adhered directly to the first riser surface, wherein the first grip member includes a first grip interior surface, wherein the first layer comprising the aerogel includes an outer surface that is adjacent the first grip interior surface.

14. The archery bow of claim 13, wherein the first layer includes an outer polymeric layer which includes the outer surface, wherein the outer polymeric layer is spaced a distance from the first grip interior surface.

15. The archery bow of claim 11, wherein the first layer includes an outer polymeric layer which includes an outer surface, wherein the outer surface faces a first grip interior surface of the first grip member.

16. The archery bow of claim 11 comprising:

a second layer comprising the aerogel disposed in a second recess defined in the riser grip area; and a second grip member disposed over the second layer in the riser grip area including a second exterior grip surface configured to engage the hand of a user when the user holds the archery bow, wherein the first grip member faces rearward of the riser and the second grip member faces forward of the riser.

17. The archery bow of claim 11, wherein the aerogel has a density of less than 0.1 g/cm$^3$, and wherein the aerogel is a foam and comprises as least 95% gas.

18. A weapon comprising:

a user engagement area including a first surface on the weapon;

a first layer comprising an aerogel, the first layer disposed adjacent the first surface; and a first engagement member disposed over the first layer in the user engagement area, the first engagement member including an exterior surface configured to engage an appendage of a user when the user holds the weapon, wherein the first layer insulates the first engagement member, whereby thermal energy transfer between the user and the weapon is impaired.

19. The weapon of claim 18, wherein the user engagement area is at least one of a butt stock, a cheek member, a fore end, a handguard and a grip of a firearm.

20. The weapon of claim 18, wherein the user engagement area is a grip of a bow, wherein the aerogel has a density of less than 0.1 g/cm$^3$, and wherein the aerogel is a foam and comprises at least 95% gas.

* * * * *